US008993987B2

(12) United States Patent
Umeda

(10) Patent No.: US 8,993,987 B2
(45) Date of Patent: Mar. 31, 2015

(54) TARGET SUPPLY DEVICE AND EXTREME ULTRAVIOLET LIGHT GENERATION APPARATUS

(71) Applicant: Gigaphoton Inc., Oyama-shi, Tochigi (JP)

(72) Inventor: Hiroshi Umeda, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/012,642

(22) Filed: Aug. 28, 2013

(65) Prior Publication Data

US 2014/0061512 A1 Mar. 6, 2014

(30) Foreign Application Priority Data

Aug. 30, 2012 (JP) ..... 2012-189886

(51) Int. Cl.
*G21K 1/00* (2006.01)
*H05G 2/00* (2006.01)

(52) U.S. Cl.
CPC ..... *H05G 2/006* (2013.01); *H05G 2/008* (2013.01); *H05G 2/005* (2013.01)
USPC ..... 250/503.1; 250/493.1; 250/504 R

(58) Field of Classification Search
USPC ..... 250/493.1, 503.1, 504 R
See application file for complete search history.

(56) References Cited

U.S. PATENT DOCUMENTS

| | | | | |
|---|---|---|---|---|
| 7,122,816 | B2 | 10/2006 | Algots et al. | |
| 7,449,703 | B2 | 11/2008 | Bykanov | |
| 2010/0143202 | A1 | 6/2010 | Yabu et al. | |
| 2013/0228709 | A1 * | 9/2013 | Umeda et al. | 250/493.1 |

* cited by examiner

*Primary Examiner* — Nicole Ippolito
*Assistant Examiner* — Hanway Chang
(74) *Attorney, Agent, or Firm* — McDermott Will & Emery LLP

(57) ABSTRACT

A target supply device may include a receptacle for holding a liquid target material, a first electrode disposed within the receptacle, a nozzle portion provided in the receptacle, a second electrode provided with a first path and disposed facing the nozzle portion, a third electrode provided with a second path that, along with the first path, defines a trajectory of the liquid target material released from the nozzle portion, a first power source that applies a first potential that is higher than a common potential to the first electrode, a second power source that applies a second potential that is lower than the common potential to the third electrode, and a third power source that applies a third potential that is no greater than the first potential and is no less than the second potential to the second electrode.

8 Claims, 6 Drawing Sheets

TARGET SUPPLY DEVICE AND EXTREME ULTRAVIOLET LIGHT GENERATION APPARATUS

CROSS-REFERENCE TO A RELATED APPLICATION

The present application claims priority from Japanese Patent Application No. 2012-189886 filed Aug. 30, 2012.

BACKGROUND

1. Technical Field

The present disclosure relates to target supply devices and extreme ultraviolet light generation apparatuses.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LFP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to an aspect of the present disclosure may include a receptacle, a first electrode, a nozzle portion, a second electrode, a third electrode, a first power source, a second power source, and a third power source. The receptacle may be configured to hold a liquid target material inside the receptacle. The first electrode may be disposed within the receptacle. The nozzle portion may be provided in the receptacle. The second electrode may be provided with a first path and may be disposed facing the nozzle portion. The third electrode may be provided with a second path that, along with the first path, defines a trajectory of the liquid target material released from the nozzle portion. The first power source may be configured to take a common potential as a reference potential and apply a first potential that is higher than the common potential to the first electrode. The second power source may be configured to take the common potential as a reference potential and apply a second potential that is lower than the common potential to the third electrode. The third power source may be configured to take the common potential as a reference potential and apply a third potential that is no greater than the first potential and is no less than the second potential to the second electrode.

A target supply device according to another aspect of the present disclosure may include a receptacle, a first electrode, a nozzle portion, a second electrode, a third electrode, a first power source, a second power source, and a third power source. The receptacle may be configured to hold a liquid target material inside the receptacle. The first electrode may be disposed within the receptacle. The nozzle portion may be provided in the receptacle. The second electrode may be provided with a first path and disposed facing the nozzle portion. The third electrode may be provided with a second path that, along with the first path, defines a trajectory of the liquid target material released from the nozzle portion. The first power source may be configured to take the common potential as a reference potential and apply a first potential that is lower than the common potential to the first electrode. The second power source may be configured to take the common potential as a reference potential and apply a second potential that is higher than the common potential to the third electrode. The third power source may be configured to take the common potential as a reference potential and apply a third potential that is no greater than the first potential and is no less than the second potential to the second electrode.

An extreme ultraviolet light generation apparatus according to another aspect of the present disclosure may be configured to generate extreme ultraviolet light by irradiating a liquid target material with a pulse laser beam and turning the liquid target material into plasma, and may include a chamber, an optical system, a receptacle, a first electrode, a nozzle portion, a second electrode, a third electrode, a first power source, a second power source, and a third power source. The chamber may be provided with a through-hole. The optical system may be configured to conduct the pulse laser beam to a predetermined region in the chamber via the through-hole. The receptacle may be configured to hold the liquid target material inside the receptacle. The first electrode may be disposed within the receptacle. The nozzle portion may be provided in the receptacle. The second electrode may be provided with a first path and may be disposed facing the nozzle portion. The third electrode may be provided with a second path that, along with the first path, defines a trajectory of the liquid target material released from the nozzle portion toward the predetermined region. The first power source may be configured to take a common potential as a reference potential and apply a first potential that is higher than the common potential to the first electrode. The second power source may be configured to take the common potential as a reference potential and apply a second potential that is lower than the common potential to the third electrode. The third power source may be configured to take the common potential as a reference potential and apply a third potential that is no greater than the first potential and is no less than the second potential to the second electrode.

An extreme ultraviolet light generation apparatus according to another aspect of the present disclosure may be configured to generate extreme ultraviolet light by irradiating a liquid target material with a pulse laser beam and turning the liquid target material into plasma, and may include a chamber, an optical system, a receptacle, a first electrode, a nozzle portion, a second electrode, a third electrode, a first power source, a second power source, and a third power source. The chamber may be provided with a through-hole. The optical system may be configured to conduct the pulse laser beam to a predetermined region in the chamber via the through-hole. The receptacle may be configured to hold the liquid target material inside the receptacle. The first electrode may be disposed within the receptacle. The nozzle portion may be provided in the receptacle. The second electrode may be provided with a first path and may be disposed facing the nozzle portion. The third electrode may be provided with a second path that, along with the first path, defines a trajectory of the liquid target material released from the nozzle portion toward the predetermined region. The first power source may be configured to take the common potential as a reference potential and apply a first potential that is lower than the common potential to the first electrode. The second power source may be configured to take the common potential as a reference potential and apply a second potential that is higher than the common potential to the third electrode. The third power source may be configured to take the common potential as a reference potential and apply a third potential that is no less than the first potential and is no greater than the second potential to the second electrode.

BRIEF DESCRIPTION OF THE DRAWINGS

Hereinafter, selected embodiments of the present disclosure will be described with reference to the accompanying drawings.

DETAILED DESCRIPTION

Figure 1:
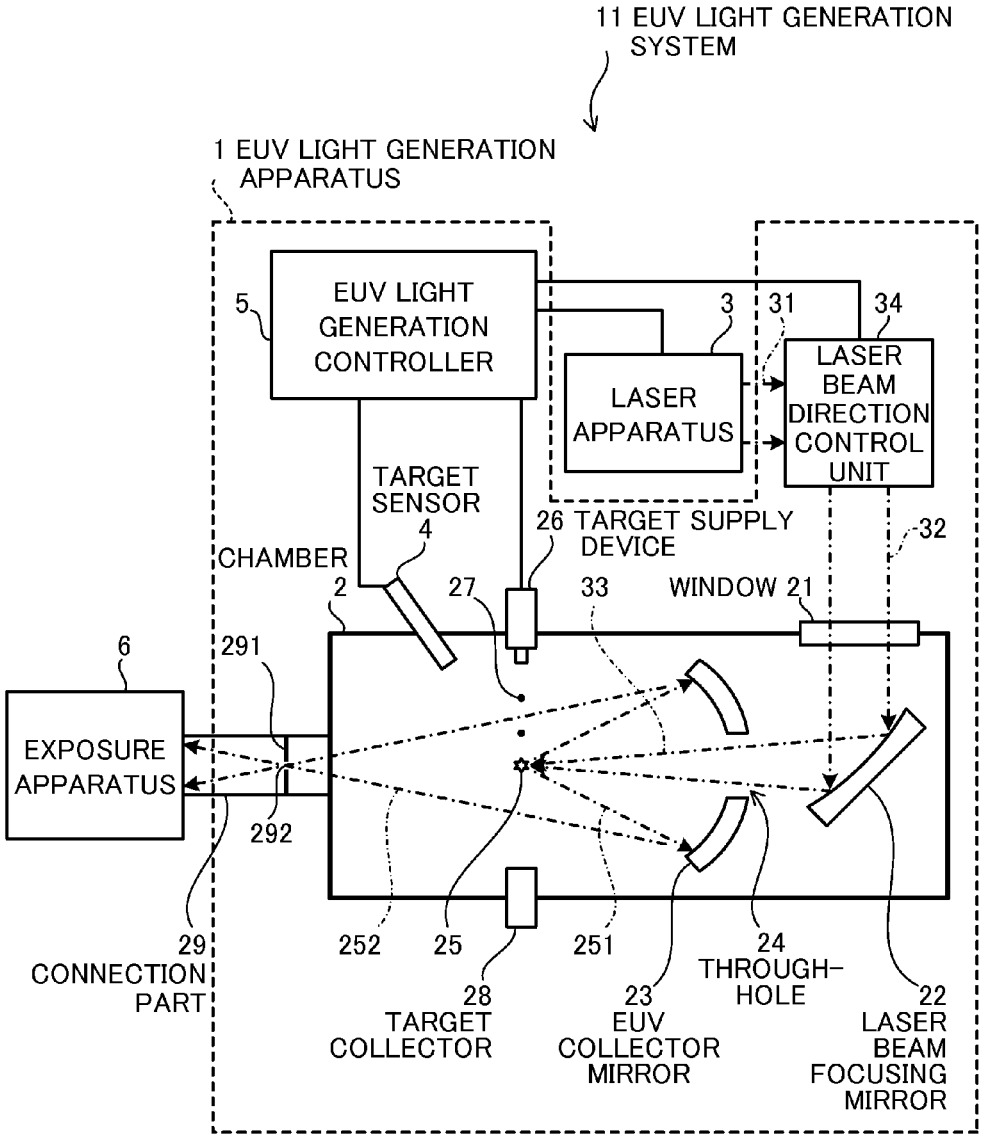
FIG. 1 schematically illustrates an exemplary configuration of an LPP type EUV light generation system.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Overview
2. Terms
3. Overview of EUV Light Generation System
3.1 Configuration
3.2 Operation
4. Target Supply Device Having First to Third Electrodes
4.1 Configuration
4.2 Operation
4.3 Variation
5. EUV Light Generation Apparatus Having Target Collector as Fourth Electrode
6. EUV Light Generation Apparatus Having Fourth Electrode Separate from Target Collector

1. Overview

In an LPP-type EUV light generation apparatus, a target supply device may output a target so that the target reaches a plasma generation region. By irradiating the target with a pulse laser beam at the point in time when the target reaches the plasma generation region, the target can be turned into plasma and EUV light can be radiated from the plasma.

The target supply device may include a reservoir that holds a melted target material to serve as the material for the target, a first electrode that is electrically connected to the melted target material, and a first power source that applies a first potential to the first electrode. The target supply device may further include a second electrode disposed facing a through-hole in a nozzle portion and a third electrode disposed in the vicinity of a trajectory of the target that has passed the second electrode. The target supply device may also include a second power source that applies a second potential that is lower than the first potential to the third electrode, and a third power source that applies a third potential that is no greater than the first potential and no less than the second potential to the second electrode.

The target outputted from the through-hole in the nozzle portion by a potential difference between the first electrode and the second electrode may be a charged droplet. A potential slope may be formed in the trajectory of the target by the potential difference between the second electrode and the third electrode, and the target may be accelerated as a result.

In EUV light generation apparatuses, there can be demand for increases in the repetition rate of EUV light generation. It can be necessary to increase the repetition rate of target generation in order to increase the repetition rate of EUV light generation. In the case where the repetition rate of the target generation is increased, the interval between previous and following targets can drop if the velocity at which the targets travel from the target supply device to the plasma generation region is not to be increased. When the interval between previous and following targets is short, the travel of the following target may be affected by the plasma produced when the previous target is turned into plasma. Accordingly, it can be necessary to increase the velocity at which the targets travel.

In a target supply device that uses the aforementioned first to third electrodes, it can be necessary to increase the potential difference between the first electrode and the third electrode in order to increase the velocity at which the targets travel. However, in the case where the potential difference between the electrodes is increased, it can be necessary to increase the insulation breakdown voltage of the cables, feedthroughs, and so on that connect the respective power sources to the electrodes, which in turn can make it necessary to increase the size of the apparatus.

According to an aspect of the present disclosure, a first potential that is higher than a common potential may be applied to the first electrode, a second potential that is lower than the common potential may be applied to the third electrode, and a third potential that is no greater than the first potential and no less than the second potential may be applied to the second electrode. Through this, the potential difference between the first potential and the second potential can be greater than the potential difference between the common potential and the first potential, the potential difference between the common potential and the second potential, and so on. Accordingly, the velocity at which the targets travel can be increased by increasing the potential difference between the first potential and the second potential while suppressing insulation breakdown by suppressing the potential difference between the common potential and the first potential, the potential difference between the common potential and the second potential, and so on. Through this, the repetition rate of EUV light generation can be improved.

2. Terms

Several terms used in the present application will be described hereinafter.

A "trajectory" of a target may be an ideal path of a target outputted from a target supply device, or may be a path of a target according to the design of a target supply device.

The "trajectory" of the target may also be the actual path of the target outputted from the target supply device.

A "high-voltage power source 55" can correspond to a "first power source".

A "high-voltage power source 58" can correspond to a "second power source".

A "high-voltage pulse generator 56" can correspond to a "third power source".

A "high-voltage power source 57" can correspond to a "fourth power source".

A "target collector 28*a*" or a "downstream electrode 69" can correspond to a "fourth electrode".

3. Overview of EUV Light Generation System

3.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 26. The chamber 2 may be sealed airtight. The target supply device 26 may be mounted onto the chamber 2, for example, to penetrate a wall of the chamber 2. A target material to be supplied by the target supply device 26 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

3.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

4. Target Supply Device Having First to Third Electrodes

4.1 Configuration

Figure 2:
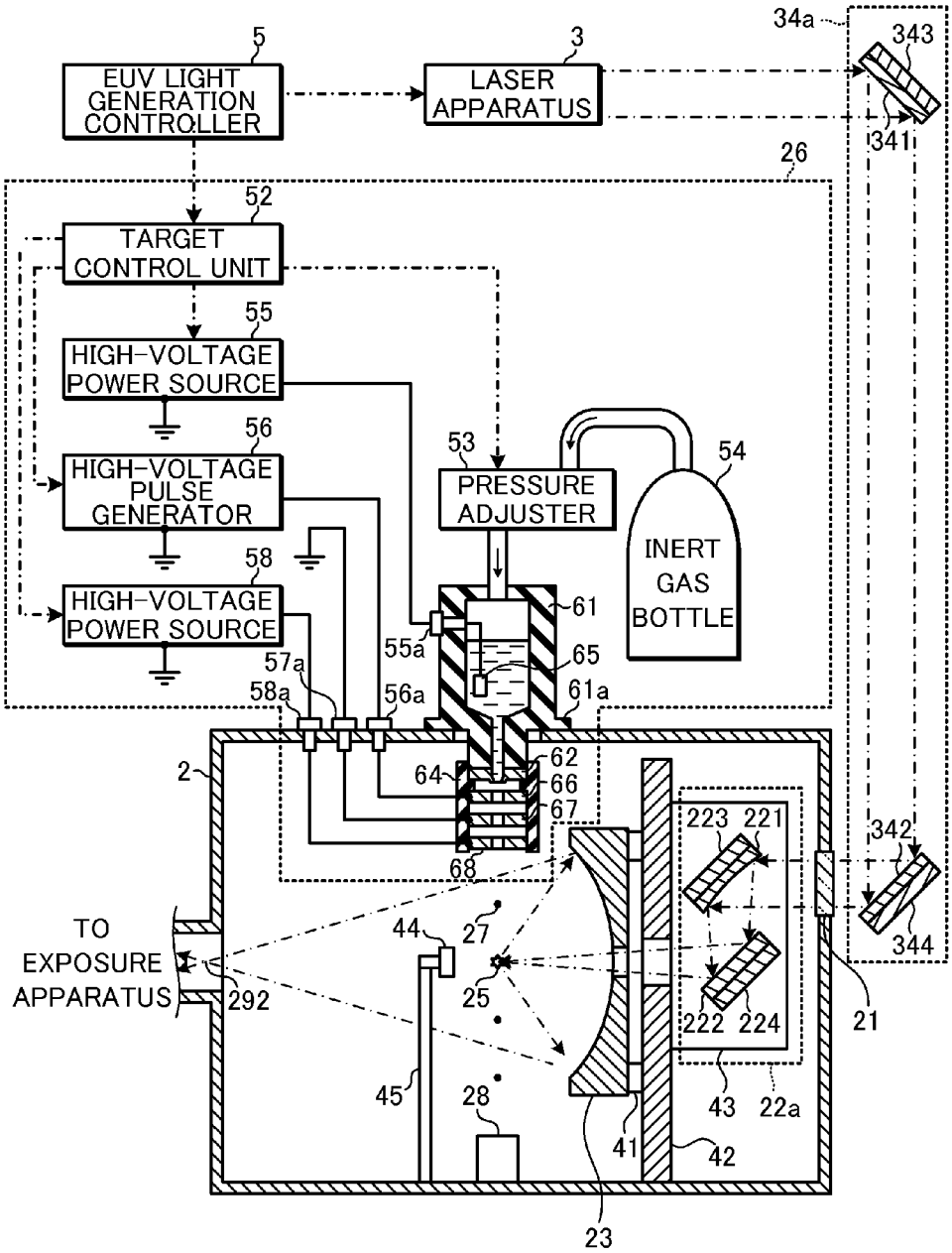
FIG. 2 is a partial cross-sectional view illustrating the configuration of an EUV light generation apparatus that includes a target supply device according to a first embodiment.
Figure 3A:
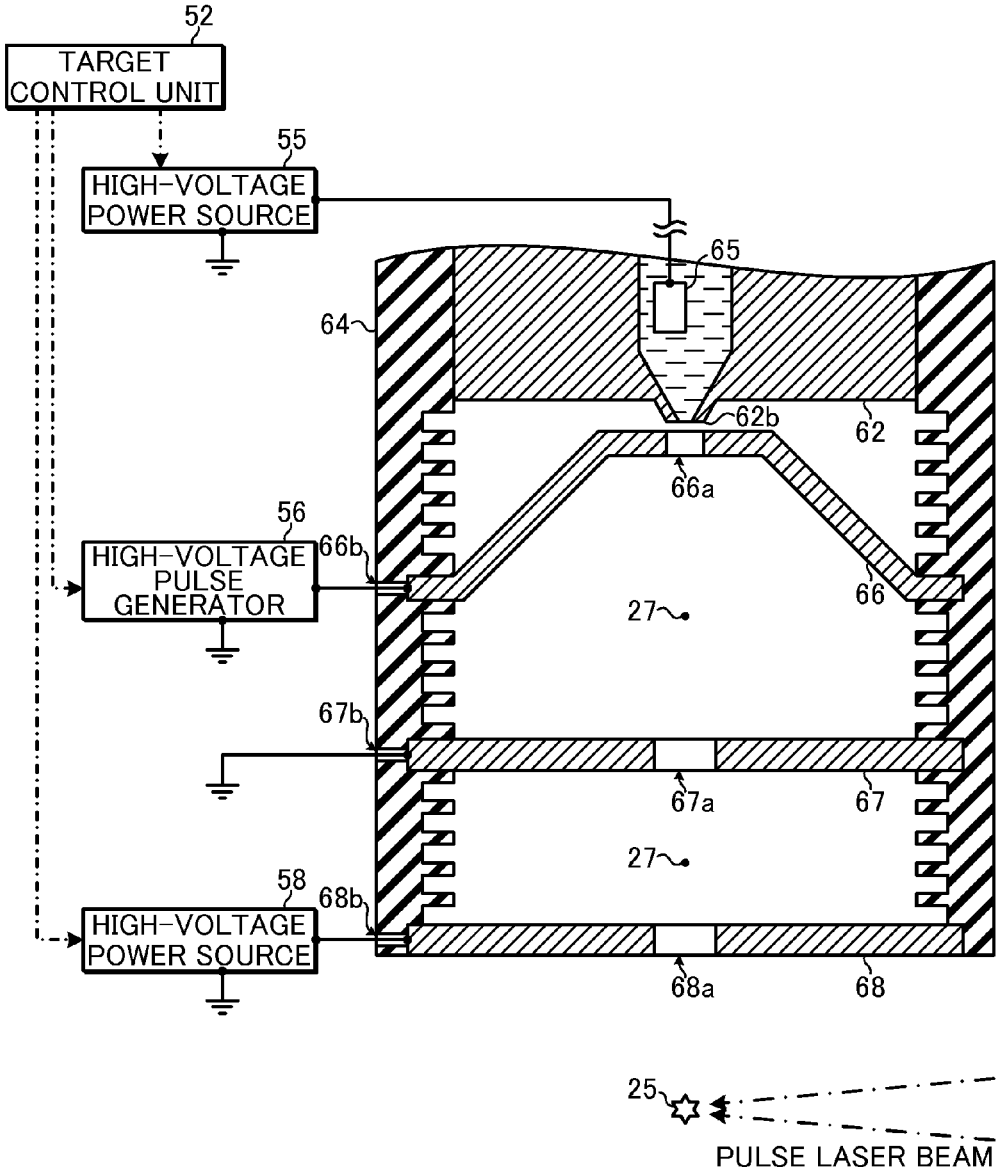
FIG. 3A is a partial cross-sectional view illustrating a nozzle portion and the periphery of the nozzle portion in the target supply device illustrated in FIG. 2.
Figure 3B:
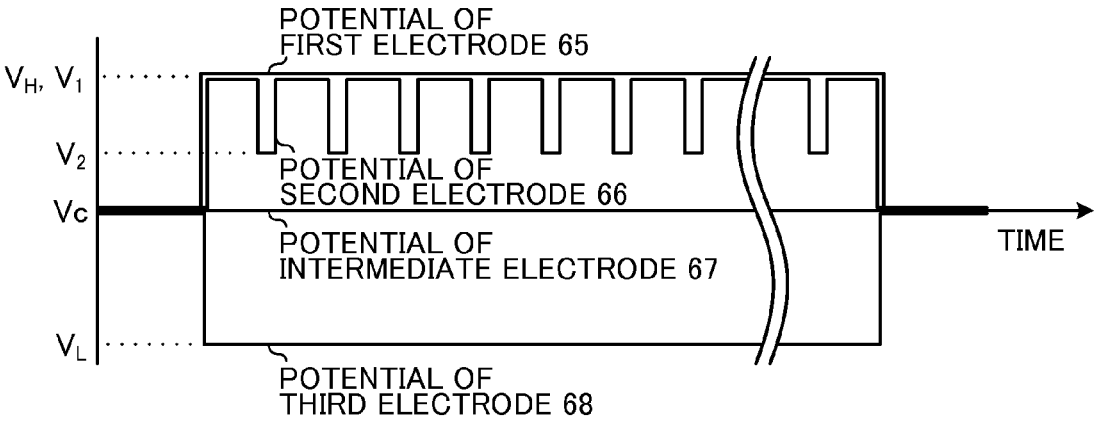
FIG. 3B is a waveform diagram illustrating potentials applied to electrodes in the target supply device illustrated in FIG. 2.

FIG. 2 is a partial cross-sectional view illustrating the configuration of an EUV light generation apparatus that includes a target supply device according to a first embodiment. FIG. 3A is a partial cross-sectional view illustrating a nozzle portion and the periphery of the nozzle portion in the target supply device illustrated in FIG. 2. FIG. 3B is a waveform diagram illustrating potentials applied to electrodes in the target supply device illustrated in FIG. 2.

As shown in FIG. 2, a laser beam focusing optical system 22*a*, the EUV collector mirror 23, the target collector 28, an EUV collector mirror holder 41, plates 42 and 43, a beam dump 44, and a beam dump support member 45 may be provided within the chamber 2.

The chamber 2 may include a member (a conductive member) configured of a conductive material (metal material, for example). The chamber 2 may also include the conductive member and a member that is electrically insulative. The plate 42 may be anchored to the chamber 2, and the plate 43 may be anchored to the plate 42. The EUV collector mirror 23 may be anchored to the plate 42 via the EUV collector mirror holder 41.

The laser beam focusing optical system 22*a* may include an off-axis paraboloid mirror 221, a flat mirror 222, and holders 223 and 224. The off-axis paraboloid mirror 221 and the flat mirror 222 may be held by the holders 223 and 224, respectively. The holders 223 and 224 may be anchored to the plate 43. The off-axis paraboloid mirror 221 and the flat mirror 222 may be held in positions and orientations in which pulse laser beams reflected by those respective mirrors are focused at the plasma generation region 25.

The beam dump 44 may be anchored to the chamber 2 via the beam dump support member 45 so as to be positioned upon a straight line extending from the optical path of the pulse laser beam reflected by the flat mirror 222. The target collector 28 may be disposed upon a straight line extending from the trajectory of the target 27.

A laser beam direction control unit 34*a* and the EUV light generation controller 5 may be provided outside the chamber 2. The laser beam direction control unit 34*a* may include high-reflecting mirrors 341 and 342, as well as holders 343 and 344. The high-reflecting mirrors 341 and 342 may be held by the holders 343 and 344, respectively.

The target supply device 26 may be attached to the chamber 2. The target supply device 26 may include a reservoir 61, a target control unit 52, a pressure adjuster 53, an inert gas bottle 54, a high-voltage power source 55 (first power source), a high-voltage pulse generator 56 (third power source), and a high-voltage power source 58 (second power source). The target supply device 26 may further include a nozzle plate 62, an electric insulation member 64, a first electrode 65, a second electrode (extraction electrode) 66, an intermediate electrode 67, and a third electrode (acceleration electrode) 68.

The reservoir 61 may hold a target material in a melted state. A heater and a heater power source (not shown) may be used to melt the target material. A through-hole may be formed in a wall of the chamber 2, and a flange portion 61*a* of the reservoir 61 may be anchored to the wall of the chamber 2 so as to cover the through-hole. The reservoir 61 may be formed of a material that does not easily react with the target material. Furthermore, the reservoir 61 may be configured of an electrically insulative material. For example, in the case where tin is used as the target material, the reservoir 61 may be configured of an electrically insulative material which does not easily react with the target material, such as silica ($SiO_2$) and alumina ceramics ($Al_2O_3$). Alternatively, the reservoir may be configured of a conductive material. For example, in the case where tin is used as the target material, molybdenum (Mo), tungsten (W), and so on can be given as examples of materials that do not easily react with the target material and that are conductive. The reservoir that is configured of a conductive material may be attached to the conductive member of the chamber 2 via an electrically insulative member (not shown).

The nozzle plate 62 may be anchored to the vicinity of an output-side end of the reservoir 61. The nozzle plate 62 may be configured of a conductive material, or may be configured of an electrically-insulative material. A through-hole may be formed in the nozzle plate 62. In addition, the nozzle plate 62 may include a leading end portion 62*b* (see FIG. 3A) that protrudes in the output direction. The through-hole may be provided in the leading end portion 62*b*. The target material can, as a liquid, pass through the through-hole provided in the leading end portion 62*b* and be released as the targets 27.

The electric insulation member 64 may have a cylindrical shape, and may be anchored to the reservoir 61 so that an end portion on the output side of the reservoir 61 is housed within the electric insulation member 64. The electric insulation member 64 may hold the nozzle plate 62, the second electrode 66, the intermediate electrode 67, and the third electrode 68 on the inside of the electric insulation member 64. The nozzle plate 62, the second electrode 66, the intermediate electrode 67, and the third electrode 68 may be electrically insulated from each other by the electric insulation member 64. A plurality of grooves may be formed on an inner side of the electric insulation member 64. The plurality of grooves can suppress discharges between the electrodes held on the inner side of the electric insulation member 64.

The second electrode 66 may be disposed facing a surface of the nozzle plate 62 on the output side thereof. A through-hole 66*a* (first path) may be formed in the second electrode 66. The second electrode 66 may allow the target 27 to pass therethrough via the through-hole 66*a*. The through-hole 66*a* may define a trajectory of the target 27. However, the second electrode 66 is not limited to a form in which the through-hole 66*a* is formed therein. For example, the second electrode 66 may include a plurality of members (not shown) disposed in the vicinity of the trajectory of the target 27 so as to surround the trajectory of the target 27. The region surrounded by the plurality of members may serve as a path (the first path) for allowing the targets 27 to pass.

The intermediate electrode 67 may be disposed in the vicinity of the trajectory of the target 27 that has passed through the through-hole 66*a* in the second electrode 66. A through-hole 67*a* (third path) may be formed in the intermediate electrode 67. The intermediate electrode 67 may allow the target 27 to pass therethrough via the through-hole 67*a*. The through-hole 67*a* may define the trajectory of the target 27. However, the intermediate electrode 67 is not limited to a form in which the through-hole 67*a* is formed therein. For example, the intermediate electrode 67 may include a plurality of members (not shown) disposed in the vicinity of the trajectory of the target 27 so as to surround the trajectory of the target 27. The region surrounded by the plurality of members may serve as a path (the third path) for allowing the targets 27 to pass.

The third electrode 68 may be disposed in the vicinity of the trajectory of the target 27 that has passed through the through-hole 67*a* in the intermediate electrode 67. A through-hole 68*a* (second path) may be formed in the third electrode 68. The third electrode 68 may allow the target 27 to pass therethrough via the through-hole 68*a*. The through-hole 68*a* may define the trajectory of the target 27. However, the third electrode 68 is not limited to a form in which the through-hole 68*a* is formed therein. For example, the third electrode 68 may include a plurality of members (not shown) disposed in the vicinity of the trajectory of the target 27 so as to surround the trajectory of the target 27. The region surrounded by the plurality of members may serve as a path (the second path) for allowing the targets 27 to pass.

The target control unit 52 may be configured to output a target control signal to each of the pressure adjuster 53, the high-voltage power source 55, and the high-voltage power source 58, based on an EUV control signal from the EUV light generation controller 5. In addition, the target control unit 52 may be configured to output a trigger signal to the high-voltage pulse generator 56 based on an EUV control signal from the EUV light generation controller 5.

The inert gas bottle 54 may be connected to the pressure adjuster 53 via a pipe. The pressure adjuster 53 may communicate with the interior of the reservoir 61 via another pipe. An inert gas may be supplied to the reservoir 61 from the inert gas bottle 54 via these pipes.

An output terminal of the high-voltage power source 55 may be electrically connected to a high-voltage cable. This high-voltage cable may be electrically connected to the first electrode 65 within the reservoir 61 via a feedthrough 55*a* (introduction terminal) provided in the reservoir 61. The first electrode 65 may be electrically connected to the target material held within the reservoir 61 by making contact with the target material within the reservoir 61. Alternatively, in the case where the reservoir 61 or the nozzle plate 62 is conductive, the output terminal of the high-voltage power source 55 may be electrically connected to the conductive reservoir 61 or nozzle plate 62 via the high-voltage cable. The reservoir 61 or nozzle plate 62 being conductive may function as an electrode that is electrically connected to the target material within the reservoir 61.

The high-voltage power source 55 may apply a first potential that is higher than a common potential, for example, to the first electrode 65. Here, the common potential may be a potential that is a reference potential for the high-voltage power source 55, the high-voltage pulse generator 56, and the high-voltage power source 58. This potential can, for example, be a ground potential. In the case where the target supply device 26 that includes the high-voltage power source 55, the high-voltage pulse generator 56, and the high-voltage power source 58 is insulated from the ground, the common potential can be a different potential from the ground potential.

An output terminal of the high-voltage power source 58 may be electrically connected to a high-voltage cable. This high-voltage cable may be electrically connected to the third electrode 68 via a feedthrough 58*a* (introduction terminal) provided in a wall of the chamber 2 and a through-hole 68*b* provided in a side surface of the electric insulation member 64. The high-voltage power source 58 may apply a second potential to the third electrode 68. Here, in the case where the first potential is a higher potential than the common potential, the second potential may be a lower potential than the common potential. Conversely, in the case where the first potential is a lower potential than the common potential, the second potential may be a higher potential than the common potential.

An output terminal of the high-voltage pulse generator 56 may be electrically connected to a high-voltage cable. This high-voltage cable may be electrically connected to the second electrode 66 via a feedthrough 56*a* (introduction terminal) provided in a wall of the chamber 2 and a through-hole 66*b* provided in a side surface of the electric insulation member 64. The high-voltage pulse generator 56 may apply a third potential that is between the first potential and the common potential to the second electrode 66. For example, in the case where the first potential is a higher potential than the common potential, the third potential may be a potential that is no higher than the first potential and no lower than the common potential. Conversely, in the case where the first potential is a lower potential than the common potential, the third potential may be a potential that is no lower than the first potential and no higher than the common potential. The third potential may be a potential that changes in pulses between a potential $V_1$ and a potential $V_2$ (mentioned later), which are potentials between the first potential and the common potential.

The intermediate electrode 67 may be electrically connected to the common potential (ground potential, for example) via a through-hole 67*b* provided in a side surface of the electric insulation member 64 and a feedthrough 57*a* (introduction terminal) provided in a wall of the chamber 2.

4.2 Operation

The pressure adjuster 53 may adjust the pressure of the inert gas supplied to the reservoir 61 from the inert gas bottle 54 based on the target control signal outputted from the target control unit 52. The inert gas introduced into the reservoir 61 may pressurize the melted target material within the reservoir 61. As a result of the inert gas pressurizing the target material, the target material may protrude slightly from the leading end portion 62*b* of the nozzle plate 62, in which the through-hole is provided.

As illustrated in FIG. 3B, the high-voltage power source 55 may apply a first potential $V_H$ to the target material via the first electrode 65 in the reservoir 61, and hold that potential, based on the target control signal outputted from the target control unit 52.

The potential of the intermediate electrode 67 may be held at a common potential Vc (ground potential, for example).

The high-voltage power source 58 may apply a second potential $V_L$ to the third electrode 68 and hold that potential, based on the target control signal outputted from the target control unit 52. In the case where the common potential Vc is the ground potential (0 V), the second potential $V_L$ may have the opposite polarity to the first potential $V_H$. The absolute value of the second potential $V_L$ may be substantially the same potential as the first potential $V_H$ ($V_L=-V_H$).

The high-voltage pulse generator 56 may apply the third potential that changes in pulses to the second electrode 66 based on the trigger signal outputted from the target control unit 52. The third potential may be a potential that changes between the potential $V_1$ obtained when the high-voltage pulse generator 56 is not receiving the trigger signal and the potential $V_2$ that is held for a predetermined amount of time in the case where the high-voltage pulse generator 56 has received the trigger signal. The potentials $V_H$, $V_1$, $V_2$, Vc, and $V_L$ may be in a relationship where $V_H \geq V_1 > V_2 \geq Vc > V_L$. Conversely, in the case where the first potential is a lower potential than the common potential, the potentials may be in a relationship where $V_H \leq V_1 < V_2 \leq Vc < V_L$.

Depending on a potential difference between the first electrode 65 and the second electrode 66, an electrical field can be generated between the target material in the reservoir 61 and the second electrode 66, and a Coulomb force can be produced between the target material and the second electrode 66 as a result.

The electrical field concentrates particularly in the vicinity of the target material that protrudes from the leading end portion 62*b* under the pressure of the inert gas as described above, and thus a stronger Coulomb force can be produced between the target material protruding from the leading end portion 62*b* and the second electrode 66. Under this Coulomb force, the targets 27 can be released from the leading end portion 62*b* as charged droplets. In the case where the first potential $V_H$ is higher than the common potential Vc, that is, in the case where $V_H \geq V_1 > V_2 \geq Vc$, the targets 27 can take on a positive charge. Conversely, in the case where the first potential $V_H$ is lower than the common potential Vc, the targets 27 can take on a negative charge.

The targets 27 that have been charged and released from the leading end portion 62*b* can pass through the through-hole 66*a* of the second electrode 66, and can pass through the through-hole 67*a* in the intermediate electrode 67 having been further accelerated by the Coulomb force produced by the potential difference between the second electrode 66 and the intermediate electrode 67. When the electrical charge of the target 27 is taken as "e" and the common potential Vc is 0 V, a potential energy $E_1$ of the target 27 released from the leading end portion 62*b*, as viewed from the through-hole 67*a*, can be expressed through the following formula.

$$E_1 = eV_H$$

Note that $V_H$ represents a potential difference between the first electrode 65 and the intermediate electrode 67.

Meanwhile, when the mass of the target 27 is taken as m and the velocity of the target 27 when passing through the through-hole 67*a* in the intermediate electrode 67 is taken as $v_1$, a kinetic energy $E_2$ of the target 27 when passing through the through-hole 67*a* can be expressed through the following formula.

$$E_2=mv_1^2/2$$

Based on the law of energy conservation, $E_1$ can be equal to $E_2$. Accordingly, the velocity $v_1$ of the target 27 when passing through the through-hole 67*a* in the intermediate electrode 67 can be expressed through the following formula.

$$v_1=(2eV_H/m)^{1/2}$$

The target 27 that has passed through the through-hole 67*a* in the intermediate electrode 67 can pass through the through-hole 68*a* in the third electrode 68 having been further accelerated by the Coulomb force produced by the potential difference between the intermediate electrode 67 and the third electrode 68. Assuming that the potential $V_L$ of the third electrode 68 is approximately equal to $-V_H$, a potential energy E3 of the target 27 that has passed through the through-hole 67*a*, as viewed from the through-hole 68*a*, can be expressed through the following formula.

$$E_3=eV_H$$

Note that $V_H$ represents the potential difference between the intermediate electrode 67 and the third electrode 68.

Meanwhile, when the velocity of the target 27 when passing through the through-hole 68*a* in the third electrode 68 is taken as $v_2$, a kinetic energy $E_4$ of the target 27 when passing through the through-hole 68*a* can be expressed through the following formula.

$$E_4=mv_2^2/2$$

Based on the law of energy conservation, $E_1+E_3$ can be equal to $E_4$. Accordingly, the velocity $v_2$ of the target 27 when passing through the through-hole 68*a* in the third electrode 68 can be expressed through the following formula.

$$v_2 = (2\cdot 2eV_H/m)^{1/2} = 2^{1/2}\cdot v_1$$

Note that $X^{1/2}$ represents the positive square root of X.

As described thus far, in the case where the first potential $V_H$ has been applied to the first electrode 65 and the 2nd potential $V_L$ (where $V_L=-V_H$) has been applied to the third electrode 68, a potential difference of $2V_H$ can be produced between the first electrode 65 and the third electrode 68. In this case, the insulation breakdown voltage of the cables, terminals, and so on that connect the respective power sources and electrodes may be $V_H$, which is the potential difference between the common potential Vc (where Vc=0) and the first potential $V_H$ or the second potential $V_L$. Through this, a velocity of approximately $2^{1/2}$ times (approximately 1.4 times) the velocity achieved when only the $V_H$ potential difference is applied between the first electrode 65 and the third electrode 68 can be imparted on the target 27.

The target control unit 52 may control the pressure adjuster 53 and the high-voltage pulse generator 56 so that the target 27 is outputted at a timing provided by the EUV light generation controller 5. The target 27 outputted into the chamber 2 may be supplied to the plasma generation region 25 within the chamber 2.

The pulse laser beam outputted from the laser apparatus 3 may be reflected by the high-reflecting mirrors 341 and 342 and may enter the laser beam focusing optical system 22*a* via the window 21. The pulse laser beam that has entered into the laser beam focusing optical system 22*a* may be reflected by the off-axis paraboloid mirror 221 and the flat mirror 222. The EUV light generation controller 5 may carry out control so that the target 27 outputted from the target supply device 26 is irradiated with the pulse laser beam at the timing when the target 27 reaches the plasma generation region 25.

The potential of the second electrode 66 may be held at $V_1$ in the case where the output of the targets is to be temporarily stopped. Furthermore, the potentials of the first electrode 65, the second electrode 66, and the third electrode 68 may be controlled to take on the common potential Vc (ground potential, for example) in the case where the output of the targets is to be stopped for a longer period of time.

4.3 Variation

The intermediate electrode 67 is provided in the first embodiment that has been described with reference to FIGS. 2 to 3B. Even if the potential of the second electrode 66 varies in pulses, variations in the slope of the potential between the intermediate electrode 67 and the third electrode 68 can be suppressed by providing the intermediate electrode 67. For example, when a target is outputted and passes through the through-hole 67*a* in the intermediate electrode 67 and a pulse for outputting the next target is then applied to the second electrode 66, the influence of that pulse on the target that has passed through the through-hole 67*a* in the intermediate electrode 67 can be suppressed.

However, the present disclosure is not limited to a case where the intermediate electrode 67 is provided. Even in the case where the intermediate electrode 67 is not provided, the travel velocity of the target can be increased while suppressing insulation breakdown in the case where a higher potential than the common potential Vc is applied to the first electrode 65 and a lower potential than the common potential Vc is applied to the third electrode 68. Likewise, even in the case where the intermediate electrode 67 is not provided, the travel velocity of the target can be increased while suppressing insulation breakdown in the case where a lower potential than the common potential Vc is applied to the first electrode 65 and a higher potential than the common potential Vc is applied to the third electrode 68.

In the case where the intermediate electrode 67 is not provided, the third potential applied to the second electrode 66 may be a potential that varies between the potentials $V_1$ and $V_2$. Here, the potentials $V_H$, $V_1$, $V_2$, Vc, and $V_L$ may be in a relationship where $V_H \geq V_1 > V_2 \geq V_L$ and $V_H > Vc > V_L$. Conversely, in the case where the first potential is a lower potential than the common potential, the relationship may be $V_H \leq V_1 < V_2 \leq V_L$ and $V_H < Vc < V_L$.

In addition, although the first embodiment describes a case where the intermediate electrode 67 is electrically connected to the common potential Vc, the present disclosure is not limited thereto. A fourth potential $V_4$ that is between the first potential $V_H$ and the second potential $V_L$ may be applied to the intermediate electrode 67. In this case, the potentials $V_H$, $V_1$, $V_2$, $V_4$, Vc, and $V_L$ may be in a relationship where $V_H \geq V_1 > V_2 \geq V_4 > V_L$ and $V_H > Vc > V_L$. Conversely, in the case where the first potential is a lower potential than the common potential, the relationship may be $V_H \leq V_1 < V_2 \leq V_4 < V_L$ and $V_H < Vc < V_L$. A fourth power source (described later) configured to apply the fourth potential $V_4$ to the intermediate electrode 67 may be further provided.

Figure 4:
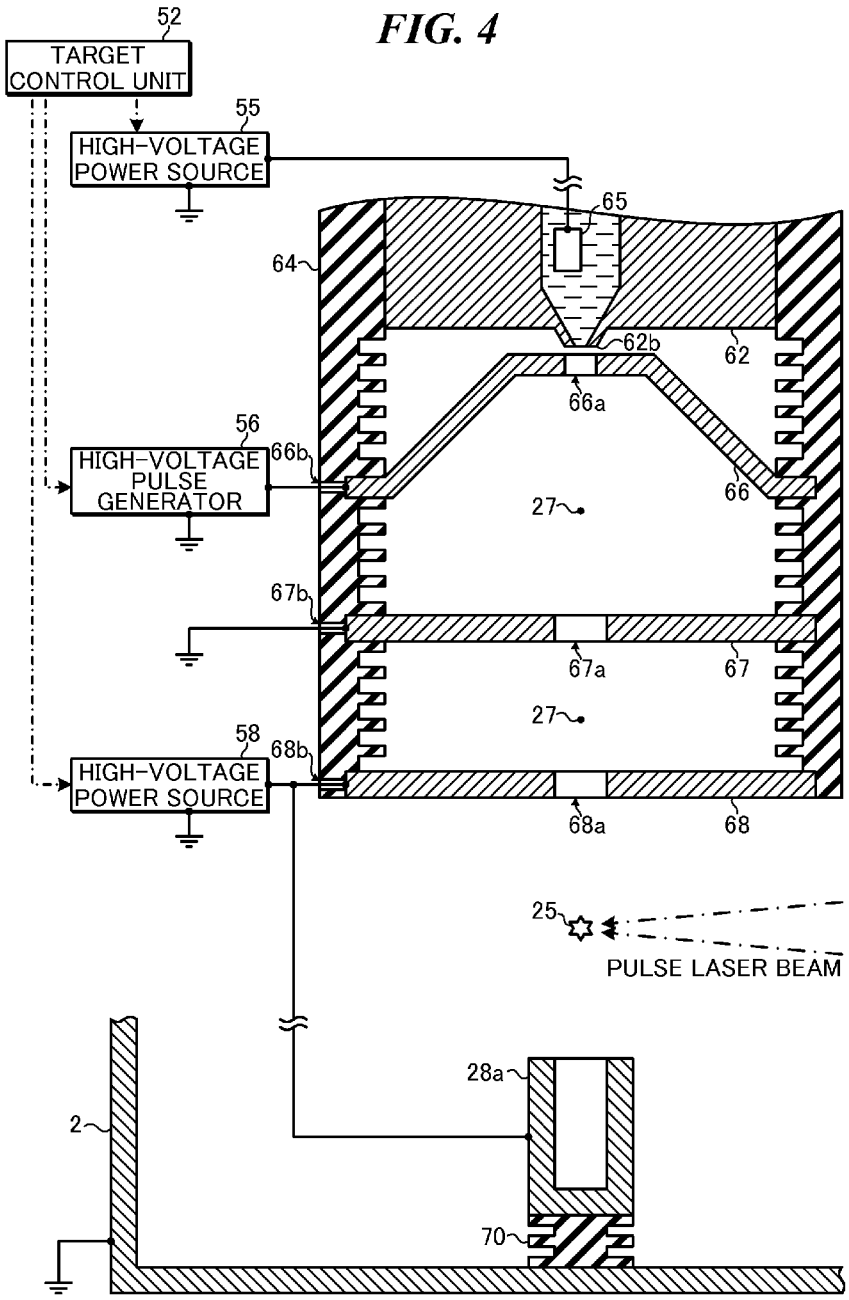
FIG. 4 is a cross-sectional view illustrating part of an EUV light generation apparatus according to a second embodiment.

5. EUV Light Generation Apparatus Having Target Collector as Fourth Electrode FIG. 4 is a cross-sectional view illustrating part of an EUV light generation apparatus according to a second embodiment. In the second embodiment, the target collector 28*a* may be configured of a conductive material, and the output terminal of the high-voltage power source 58 may be electrically connected to the target collector 28*a* (fourth electrode).

In the aforementioned first embodiment, a slope of the potential from the leading end portion 62*b* of the nozzle plate 62 to the third electrode 68 and a slope of the potential from the third electrode 68 to the plasma generation region 25 can take on opposite potential slopes in the case where the chamber 2 is connected to the common potential Vc. Accordingly, even if the target 27 is accelerated in the area from the first electrode 65 to the third electrode 68, the target 27 may decelerate to a certain extent in the area from the third electrode 68 to the plasma generation region 25.

Accordingly, in the second embodiment, the high-voltage power source 58 may apply the second potential $V_L$, which is the same potential as that applied to the third electrode 68, to the target collector 28*a*. Through this, the slope of the potential from the third electrode 68 to the plasma generation region 25 can be softened and the target 27 can be suppressed from decelerating.

The target collector 28*a* may be a cylindrical receptacle having a closed base. An electric insulation member 70 may be disposed between the target collector 28*a* and the conductive member of the chamber 2. The conductive member of the chamber 2 may be connected to the common potential Vc (ground potential, for example). A plurality of grooves may be formed on an outer surface of the electric insulation member 70. This plurality of grooves can suppress insulation breakdown between the target collector 28*a* and the conductive member of the chamber 2.

The configuration may be the same as that described in the first embodiment in other respects.

According to the second embodiment, the target 27 that has passed through the through-hole 68*a* in the third electrode 68 can reach the plasma generation region 25 while being suppressed from decelerating due to the potential difference between the third electrode 68 and the conductive member of the chamber 2. EUV light can be generated when the target 27 that has reached the plasma generation region 25 is irradiated with the pulse laser beam. Targets 27 that are not irradiated with the pulse laser beam upon reaching the plasma generation region 25 can pass through the plasma generation region 25 and be collected by the target collector 28*a*.

Note that a fifth potential that is different from the second potential $V_L$ may be applied to the target collector 28*a*. Here, in the case where the first potential $V_H$ is a higher potential than the potential applied to the conductive member of the chamber 2 (common potential Vc, for example), the fifth potential may be a lower potential than the potential applied to the conductive member of the chamber 2. Alternatively, in the case where the first potential $V_H$ is a lower potential than the potential applied to the conductive member of the chamber 2 (common potential Vc, for example), the fifth potential may be a higher potential than the potential applied to the conductive member of the chamber 2. A fifth power source (not shown) configured to apply the fifth potential to the target collector 28*a* may be further provided.

Figure 5:
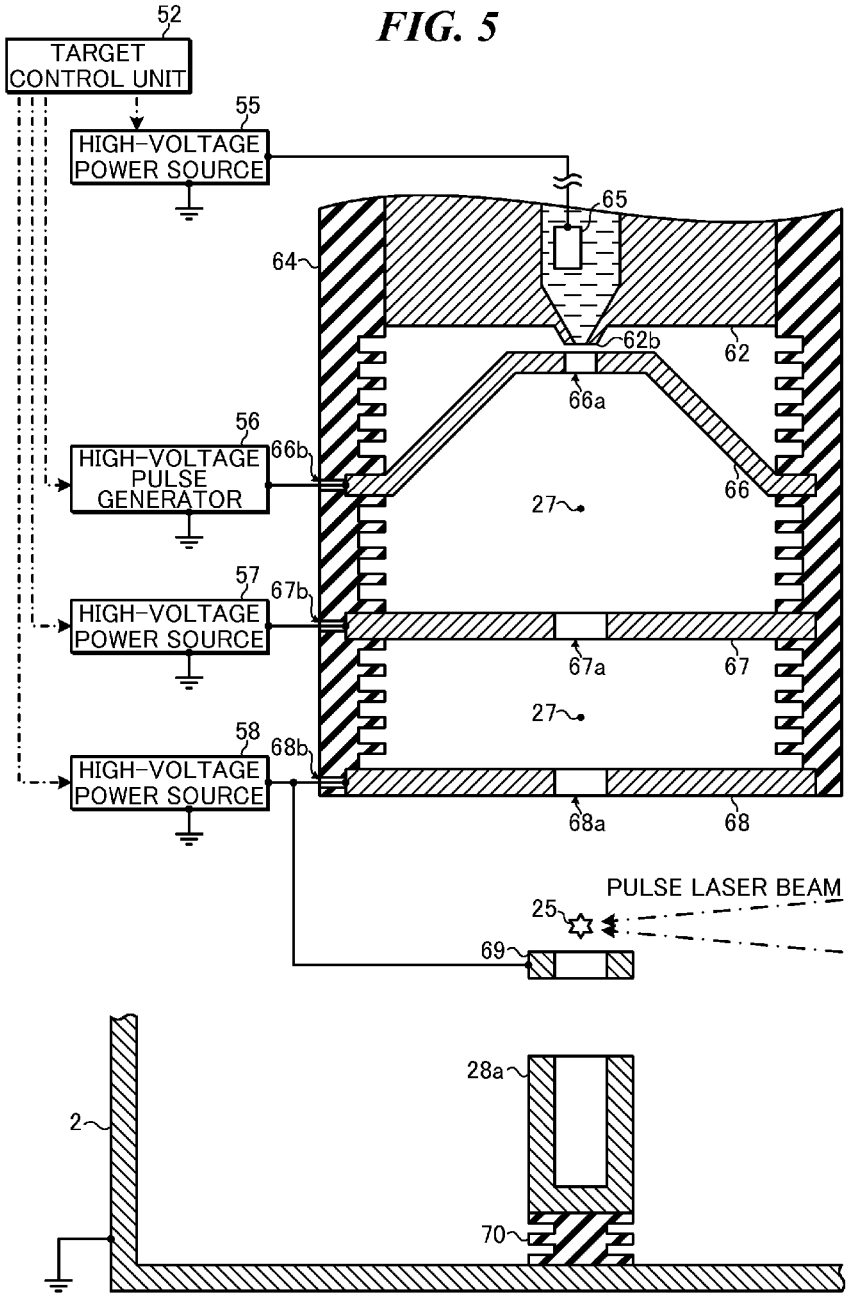
FIG. 5 is a cross-sectional view illustrating part of an EUV light generation apparatus according to a third embodiment.

6. EUV Light Generation Apparatus Having Fourth Electrode Separate from Target Collector FIG. 5 is a cross-sectional view illustrating part of an EUV light generation apparatus according to a third embodiment. In the third embodiment, a downstream electrode 69 (fourth electrode) may be disposed in the vicinity of an area downstream from the plasma generation region 25 in the trajectory of the target 27, separate from the target collector 28*a*. The output terminal of the high-voltage power source 58 may be electrically connected to the downstream electrode 69. Through this, the second potential $V_L$, which is the same as the potential applied to the third electrode 68, can be applied to the downstream electrode 69 as well. Accordingly, the slope of the potential from the third electrode 68 to the plasma generation region 25 can be softened and the target 27 can be suppressed from decelerating. The downstream electrode 69 may be anchored to the conductive member of the chamber 2 through an electric insulation member (not shown).

Note that the fifth potential that is different from the second potential $V_L$ may be applied to the downstream electrode 69. The magnitude of the fifth potential may be as described in the aforementioned second embodiment. The fifth power source (not shown) configured to apply the fifth potential to the downstream electrode 69 may be further provided.

In the third embodiment, the second potential $V_L$ or the fifth potential may be applied to the target collector 28*a*. Alternatively, the target collector 28*a* may be connected to the common potential Vc.

In addition, in the third embodiment, the fourth potential $V_4$ that is between the first potential $V_H$ and the second potential $V_L$ may be applied to the intermediate electrode 67. The magnitude of the fourth potential $V_4$ may be as described in the aforementioned first embodiment. The fourth power source (the high-voltage power source 57) configured to apply the fourth potential $V_4$ to the intermediate electrode 67 may be further provided.

The present disclosure is not limited to the case where the fourth potential $V_4$ is applied to the intermediate electrode 67. As described in the first embodiment, the intermediate electrode 67 may be connected to the common potential Vc.

The configuration may be the same as that described in the second embodiment in other respects.

In addition, the present disclosure is not limited to the case where the target collector 28*a* or the downstream electrode 69 (which both correspond to the fourth electrode) is provided. The travel velocity of the target at the plasma generation region 25 can be increased while suppressing insulation breakdown even in the case where the fourth electrode is not provided and the conductive member of the chamber 2 is connected to the common potential. This is because the velocity of the target 27 at the point in time when the target 27 passes through the plasma generation region 25 can be greater than the velocity of the target 27 at the point in time when the target 27 passes near the intermediate electrode 67 connected to the common potential.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device comprising:

a receptacle configured to hold a liquid target material inside the receptacle;

a first electrode disposed within the receptacle;

a nozzle portion provided in the receptacle;

a second electrode provided with a first path and disposed facing the nozzle portion;

a third electrode provided with a second path that, along with the first path, defines a trajectory of the liquid target material released from the nozzle portion;

a first power source that is configured to take a common potential as a reference potential and apply a first potential that is higher than the common potential to the first electrode;

a second power source that is configured to take the common potential as a reference potential and apply a second potential that is lower than the common potential to the third electrode; and a third power source that is configured to take the common potential as a reference potential and apply a third potential that is no greater than the first potential and is no less than the second potential to the second electrode.

2. The target supply device according to claim 1, further comprising:

an intermediate electrode that is disposed between the second electrode and the third electrode, is provided with a third path that defines the trajectory along with the first path and the second path, and is electrically connected to the common potential, wherein the third power source is configured to apply the third potential that is no greater than the first potential and no less than the common potential to the second electrode.

3. The target supply device according to claim 1, further comprising:

an intermediate electrode that is disposed between the second electrode and the third electrode and is provided with a third path that defines the trajectory along with the first path and the second path; and a fourth power source configured to apply a fourth potential that is lower than the first potential and higher than the second potential to the intermediate electrode, wherein the third power source is configured to apply the third potential that is no greater than the first potential and no less than the fourth potential to the second electrode.

4. A target supply device comprising:

a receptacle configured to hold a liquid target material inside the receptacle;

a first electrode disposed within the receptacle;

a nozzle portion provided in the receptacle;

a second electrode provided with a first path and disposed facing the nozzle portion;

a third electrode provided with a second path that, along with the first path, defines a trajectory of the liquid target material released from the nozzle portion;

a first power source that is configured to take a common potential as a reference potential and apply a first potential that is lower than the common potential to the first electrode;

a second power source that is configured to take the common potential as a reference potential and apply a second potential that is higher than the common potential to the third electrode; and a third power source that is configured to take the common potential as a reference potential and apply a third potential that is no less than the first potential and is no greater than the second potential to the second electrode.

5. An extreme ultraviolet light generation apparatus configured to generate extreme ultraviolet light by irradiating a liquid target material with a pulse laser beam and turning the liquid target material into plasma, the apparatus comprising:

a chamber provided with a through-hole;

an optical system configured to conduct the pulse laser beam to a predetermined region in the chamber via the through-hole;

a receptacle configured to hold the liquid target material inside the receptacle;

a first electrode disposed within the receptacle;

a nozzle portion provided in the receptacle;

a second electrode provided with a first path and disposed facing the nozzle portion;

a third electrode provided with a second path that, along with the first path, defines a trajectory of the liquid target material released from the nozzle portion toward the predetermined region;

a first power source that is configured to take a common potential as a reference potential and apply a first potential that is higher than the common potential to the first electrode;

a second power source that is configured to take the common potential as a reference potential and apply a second potential that is lower than the common potential to the third electrode; and a third power source that is configured to take the common potential as a reference potential and apply a third potential that is no greater than the first potential and is no less than the second potential to the second electrode.

6. The extreme ultraviolet light generation apparatus according to claim 5, further comprising:

a fourth electrode disposed downstream from the predetermined region in the trajectory, wherein the second power source is configured to apply the second potential to the third electrode and the fourth electrode.

7. The extreme ultraviolet light generation apparatus according to claim 5, wherein the chamber includes a conductive member; and the conductive member of the chamber is electrically connected to the common potential.

8. An extreme ultraviolet light generation apparatus configured to generate extreme ultraviolet light by irradiating a liquid target material with a pulse laser beam and turning the liquid target material into plasma, the apparatus comprising:

a chamber provided with a through-hole;

an optical system configured to conduct the pulse laser beam to a predetermined region in the chamber via the through-hole;

a receptacle configured to hold the liquid target material inside the receptacle;

a first electrode disposed within the receptacle;

a nozzle portion provided in the receptacle;

a second electrode provided with a first path and disposed facing the nozzle portion;

a third electrode provided with a second path that, along with the first path, defines a trajectory of the liquid target material released from the nozzle portion toward the predetermined region;

a first power source that is configured to take a common potential as a reference potential and apply a first potential that is lower than the common potential to the first electrode;

a second power source that is configured to take the common potential as a reference potential and apply a second potential that is higher than the common potential to the third electrode; and a third power source that is configured to take the common potential as a reference potential and apply a third potential that is no less than the first potential and is no greater than the second potential to the second electrode.

* * * * *